United States Patent [19]

Nakatake et al.

[11] 4,247,841

[45] Jan. 27, 1981

[54] THREE WINDING TRANSFORMER

[75] Inventors: Ryozi Nakatake; Teruo Fukuda; Yoshitake Kashima, all of Hitachi, Japan

[73] Assignee: Hitachi, Ltd., Japan

[21] Appl. No.: 89,379

[22] Filed: Oct. 30, 1979

[30] Foreign Application Priority Data

Nov. 6, 1978 [JP] Japan ..... 53-135810

[51] Int. Cl.[3] ..... H01F 21/12

[52] U.S. Cl. ..... 336/150; 336/170; 336/181; 336/183

[58] Field of Search ..... 323/43.5 R, 43.5 S, 323/48; 336/150, 170, 171, 180, 181, 182, 183

[56] References Cited

FOREIGN PATENT DOCUMENTS 1264600 3/1968 Fed. Rep. of Germany ..... 336/150

*Primary Examiner*—Thomas J. Kozma

*Attorney, Agent, or Firm*—Craig & Antonelli

[57] ABSTRACT

Low, middle and high voltage windings are wound on a magnetic core in this order, the high voltage winding having a high voltage line terminal at its center and neutral terminals at both ends. Two middle voltage partial windings are coaxially wound on the outside of the high voltage winding at upper and lower positions separated by a necessary distance for insulation. One end of each of the middle voltage partial windings are connected to the neutral point of the middle voltage winding, and the other ends thereof are each connected to the respective tap windings of two tap changers. Thus, the middle voltage partial windings and the tap changers constitute a parallel circuit in which a circulating current flows thereby to induce magnetic flux in each of the middle voltage partial windings and tap windings. The middle voltage partial windings and tap windings are so wound that the magnetic coupling therebetween through the induced magnetic flux can be reduced.

5 Claims, 8 Drawing Figures

THREE WINDING TRANSFORMER

BACKGROUND OF THE INVENTION

1. Field of the Invention

The present invention relates to three winding transformers, and particularly to a large-capacity three winding transformer using two parallel-connected tap changers which are connected to a middle voltage winding, for tap change-over upon loading.

2. Description of the Prior Art

The large-capacity three winding transformer for tap change-over upon loading at a middle voltage generally includes, as shown in, for example, FIG. 1 or 3, a magnetic core 11 wound thereon with the following windings, a low voltage winding 12, a middle voltage winding 13, a high voltage winding 14, and two tapped windings 15*a* and 15*b* or one tapped winding 15 which are each connected in series with the middle voltage winding 13, and of which the taps are changed over by two load tap changers 16*a* and 16*b* or one load tap changer 16, respectively.

FIG. 1 shows a three winding transformer having the magnetic core 11 on which are wound the low voltage winding 12, the middle voltage winding 13 and the high voltage winding 14 in order. The two tapped windings 15*a* and 15*b* are disposed on the outside of and are coaxial with the high voltage winding 14 and the two tapped windings 15*a* and 15*b* are separated a predetermined distance from each other. In FIG. 1, $L_1$ and $L_2$ represent low voltage terminals of the low voltage winding 12, $M_1$ and $M_0$ a line terminal and a neutral terminal of the middle voltage winding 13, respectively and $H_1$ and $H_0$ a line terminal and a neutral terminal of the high voltage terminal 14, respectively.

If the three winding transformer as shown in FIG. 1 is required to be of large capacity and to have a large current capacity of the middle voltage winding 13, the middle voltage winding 13 is formed by two windings 13*a* and 13*b* as shown in FIG. 2. The two windings 13*a* and 13*b* are connected in series with two load tap changers 16*a* and 16*b*, respectively, and the two series circuits are parallel-connected to form the whole middle voltage winding. These two parallel-connected load tap changers 16*a* and 16*b* have polarity change-over switches 20*a* and 20*b*, tap windings 15*a* and 15*b*, tap selectors 18*a* and 18*b*, and change-over switches 17*a* and 17*b*, which are connected in series with the middle voltage windings 13*a* and 13*b*, respectively.

If the taps of each tap winding 15*a*, 15*b* are selected in such a parallel circuit, the change-over switches 17*a* and 17*b* of the load tap changers 16*a* and 16*b* may become different in switching time to cause a potential difference equivalent to one-tap distance of the tapped windings 15*a* and 15*b*, and this potential difference may be applied in the parallel circuit consisting of the series circuit of the middle voltage winding 13*a*, the polarity change-over switch 20*a*, the tapped winding 15*a*, the tap selector 18*a* and the change-over switch 17*a* and the series circuit of the middle voltage winding 13*b*, the polarity change-over switch 20*b*, the tapped winding 15*b*, the tap selector 18*b* and the change-over switch 17*b*. If this potential is taken as $e_1$, a circulating current $I_c$ depending on the $e_1$ and the impedance Z of the parallel circuit is flowed in the parallel circuit. In the two parallel-connected middle voltage windings as shown in FIG. 2, an inductance L of the middle voltage windings for the circulating current $I_c$ is expressed by $$L=L_{13a}+L_{13b}+2M_{13ab},$$

where $L_{13a}$ and $L_{13b}$ are self inductances of the middle voltage windings 13*a* and 13*b*, respectively and $M_{13ab}$ is a mutual inductance between the middle voltage windings 13*a* and 13*b*. When the circulating current $I_c$ is flowed through the windings 13*a* and 13*b*, the magnetic flux induced by the winding 13*a* can be opposite in direction to that induced by the winding 13*b*, so that the mutual inductance $M_{13ab}$ can be negative. Moreover, the self inductances $L_{13a}$ and $L_{13b}$ and the mutual inductance $L_{13ab}$ can be expressed by $$L_{13a}=\mu S N_{13a}^2/l \quad (1)$$

$$L_{13b}=\mu S N_{13b}^2/l \quad (2)$$

$$M_{13ab}=K\sqrt{L_{13a}\cdot L_{13b}} \quad (3)$$

where $\mu$ is the permeability of the magnetic circuit, S the cross-sectional area of the magnetic circuit, $N_{13a}$ the number of turns of the winding 13*a* and $N_{13b}$ the number of turns of the winding 13*b*, l the length of the magnetic circuit, and K the coupling coefficient.

Since the middle voltage windings 13*a* and 13*b* can be closely coupled to each other, that is, the coupling coefficient K is equivalent to one, the inductance L becomes zero. Therefore, the impedance of the middle voltage windings 13*a* and 13*b* for the circulating current is only a winding resistance R, which is about 0.1 to 0.3 ohm in a large-capacity transformer. Consequently, the total series impedance of the middle windings 13*a* and 13*b* is about 0.1 to 0.3 ohm which is the winding resistance R.

In practice, however, the tapped windings 15*a* and 15*b* are respectively connected in series with the middle windings 13*a* and 13*b* and also coaxially disposed at upper and lower positions separated by a predetermined distance. In addition, the tapped windings 15*a* and 15*b* are so wound that by the circulating current $I_c$ the magnetic flux induced in the tapped winding 15*a* is opposite in direction to that in the tapped winding 15*b*. Thus, the tapped windings 15*a* and 15*b* have approximately zero coupling coefficient and hence the inductance thereof is not zero.

In a three winding transformer of, for example, $$\frac{800}{3}/\frac{800}{3}/\frac{266}{3}\ \text{MVA},\ \frac{500}{\sqrt{3}}/\frac{220}{\sqrt{3}}/132\ \text{KV},$$

(tap voltage, $(220\pm33)/\sqrt{3}$) class, the total series impedance of the middle windings and tapped windings for the circulating current flowing therethrough is about 5 ohms. That is, the impedance Z for the circulating current $I_c$ in the parallel circuit as shown in FIG. 2 is about 5 ohms, and in this case the potential difference $e_1$ between the taps is about 2000 to 3000 volts. Thus, the circulating current $I_c$ amounts to about several hundred amperes. The circulating current $I_c$ is superimposed upon a load current to exceed the cutoff current (in the above example, about 2500 A) of the tap changer 16*a*, 16*b*, so that the tap changers do not operate to cut off. It is also uneconomical to install a large-capacity tap changer capable of accepting this very large amount of circulating current $I_c$.

FIG. 3 shows a large-capacity three winding transformer with a middle voltage winding 13 of a large-current capacity. In this three winding transformer, the cutoff current value of the change-over switch in the load tap changer may sometimes exceed an allowable value. In this case, the tap winding 15 is formed of two coaxially disposed parallel windings 15*a* and 15*b* as shown in FIG. 4. These two parallel windings 15*a* and 15*b* are connected with the polarity change-over switches 20*a* and 20*b*, the tap selectors 18*a* and 18*b* and the change-over switches 17*a* and 17*b*, thus constituting two parallel load tap changers 16*a* and 16*b*, respectively.

Since the tapped windings 15*a* and 15*b* are coaxially disposed, when a load current flows, the tapped winding 15*a* is interlinked with a magnetic flux $\Phi_a$, and the tapped winding 15*b* with a magnetic flux $\Phi_b$. If, in this case, the amount of interlinkage flux in the tapped winding 15*a* is compared with that in the tapped winding 15*b* by using the average diameters of both the windings, the relation of $\Phi_b \approx 9\Phi_a$ results. Thus, the induced voltages by the respective interlinkage flux are not cancelled out. If the number of turns of the tapped winding 15*a*, 15*b* is taken as N, and the frequency as f, then the induced voltages $e_a$ and $e_b$ in the tapped windings 15*a* and 15*b* and the difference voltage e therebetween are given as follows:

$$e_a = 4.44\pi f N \Phi_a \quad (4)$$

$$e_b = 4.44\pi f N \Phi_b \quad (5)$$

$$e = e_b - e_a = 4.44\pi f N 8 \Phi_a \quad (6)$$

This induced voltage e is generated in the parallel circuit to cause the circulating current $I_c$ to be flowed in the parallel circuit against the impedance Z thereof which determines the value of the current $I_c$.

The inductance L for the circulating current $I_c$ can be expressed by $$L = L_{15a} + L_{15b} + 2M_{15ab} \quad (7)$$

where $L_{15a}$ and $L_{15b}$ represent the self inductances of the tapped windings 15*a* and 15*b*, respectively, and $M_{15ab}$ the mutual inductance between the tapped windings 15*a* and 15*b*. The self inductances $L_{15a}$ and $L_{15b}$ and the mutual inductance $M_{15ab}$ are expressed by $$L_{15a} = \mu S N_{15a}^2 / l \quad (8)$$

$$L_{15b} = \mu S N_{15b}^2 / l \quad (9)$$

$$M_{15ab} = K\sqrt{L_{15a}^2 \cdot L_{15b}^2} \quad (10)$$

where $N_{15a}$ and $N_{15b}$ are the numbers of turns of the tapped windings 15*a* and 15*b*, respectively.

Also in this case, the mutual inductance $M_{15ab}$ is negative similar to that in the above description, and thus the impedance Z is only the winding resistance. The resultant current of the circulating current $I_c$ and the winding load current $I_e$ may be about 130 to 150% of the winding load current depending on the selected tap. In the transformer of $$\frac{800}{3} / \frac{800}{3} / \frac{266}{3} \text{ MVA}, \frac{500}{\sqrt{3}} / \frac{220}{\sqrt{3}} / 132 \text{ KV},$$

(tap voltage, $(220 \pm 33)/\sqrt{3}$) class, the resultant current of the circulating current $I_c$ and the winding load current $I_e$ is about 140% of the winding load current. Thus, in the three winding transformer of the construction shown in FIG. 4, the same trouble as that in FIG. 1 is caused by the untimely operation of the change-over switches 17*a* and 17*b*.

SUMMARY OF THE INVENTION

An object of the present invention is to provide a transformer capable of restricting a circulating current caused by the timing of operation of the change-over switches upon tap switching for loading.

Another object of the invention is to provide a transformer in which the tap switching upon loading can be performed without using large capacity load tap changers.

Still another object of the invention is to provide a transformer in which a shorted current capacity on a low voltage side can be decreased.

The present invention proposes a three winding transformer in which two parallel-connected middle voltage partial windings are connected in series with the middle voltage winding. The middle voltage partial windings are coaxially wound on the outside of the high voltage winding so as to be separated a distance necessary for the insulation therebetween. A tapped winding is connected in series with each middle voltage partial winding. The respective middle voltage partial windings and tapped windings are arranged to reduce the magnetic coupling therebetween. Thus, the inductances of the middle voltage partial windings and tapped windings act as leakage inductances, thereby to reduce the circulating current in the middle voltage circuit including two parallel-connected middle voltage partial windings in which circulating current is caused by untimely operation of the change-over switches of the load tap changers.

Other objects, features and advantages of this invention will be apparent from the following description taken in conjunction with the accompanying drawings.

DESCRIPTION OF THE PREFERRED EMBODIMENTS

Figure 1:
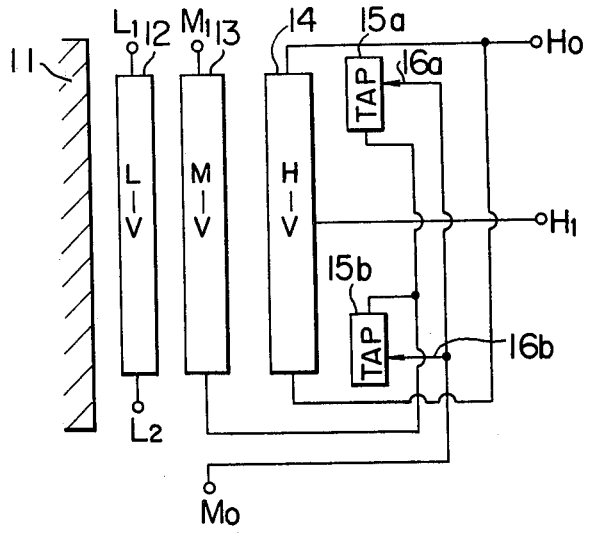
FIG. 1 PRIOR ART
FIG. 1 shows a winding arrangement of a conventional three winding transformer in which the tapped windings are provided on the outside of the high voltage winding.
Figure 2:
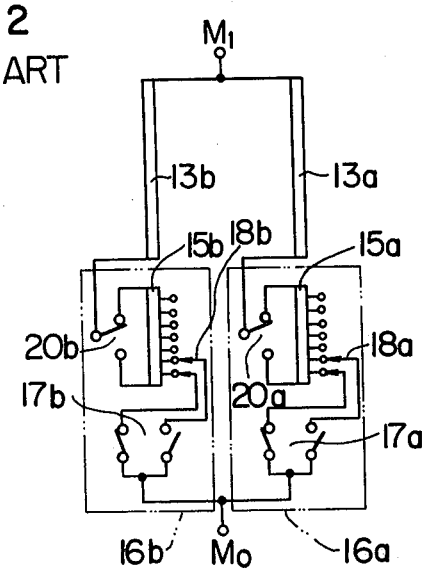
FIG. 2 PRIOR ART
FIG. 2 is a circuit diagram of the middle voltage winding at which parallel-connected load tap changers are installed.
Figure 3:
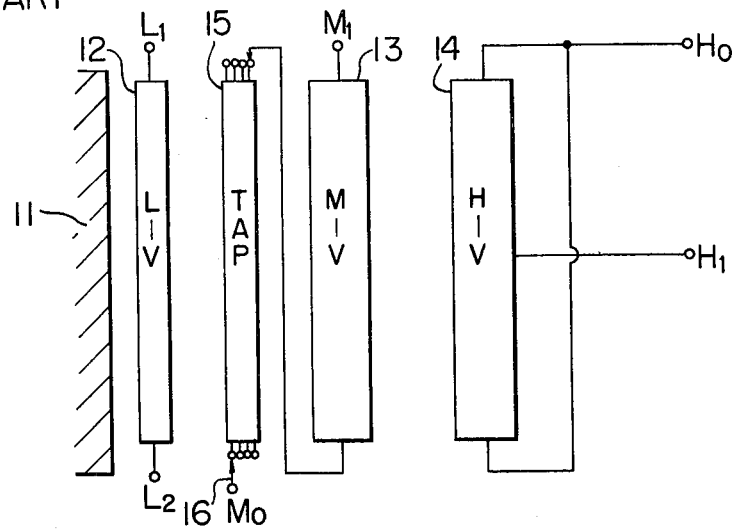
FIG. 3 PRIOR ART
FIG. 3 shows a winding arrangement of a conventional three winding transformer with the tapped winding disposed between the low voltage winding and the middle voltage winding.
Figure 4:
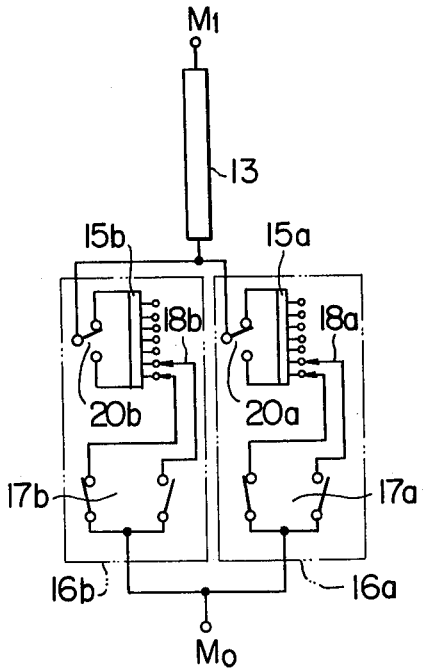
FIG. 4 PRIOR ART
FIG. 4 is a circuit diagram of the middle voltage winding which is, as shown in FIG. 3, connected with two parallel-connected load tap changers.

The present invention will now be described with reference to FIGS. 5 to 8 in which like elements corresponding to those of FIGS. 1 to 4 are identified by the same reference numerals.

Figure 5:
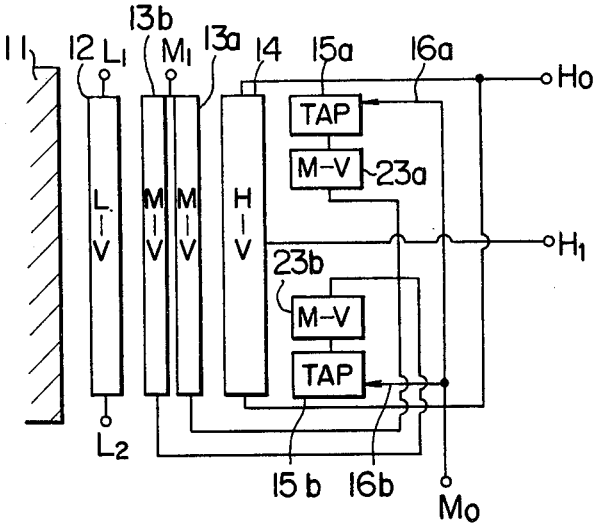
FIG. 5 shows a winding arrangement of one embodiment of the three winding transformer according to the present invention in which the tap changers are provided on the outside of the high voltage winding.

The three winding transformer of one embodiment of the invention is constructed so that, as shown in FIG. 5, a magnetic core 11 has wound thereon low voltage winding 12, the two parallel-connected middle voltage windings 13*a* and 13*b*, the high voltage winding 14 and the tapped windings 15*a* and 15*b*, in order. Middle voltage partial windings 23*a* and 23*b* as parts of the middle voltage windings 13*a* and 13*b* are coaxially wound on the outside of the high voltage winding 14 at areas separated a distance necessary for insulation therebetween. The tapped windings 15*a* and 15*b* are also wound thereon to be coaxial with the middle voltage partial windings 23*a* and 23*b*. The middle voltage partial windings 23*a* and 23*b* are wound on the high voltage winding 14 at positions close to a line terminal $H_1$ thereof, and the tapped windings 15*a* and 15*b* on the high voltage winding at positions close to a neutral terminal $H_0$ thereof. The windings 15*a* and 23*a* are connected in series and the windings 23*b* and 15*b* are also in series. Although in this embodiment the middle voltage partial windings 23*a* and 23*b* are respectively connected close to the neutral point $M_o$ of the middle voltage windings 13*a* and 13*b*, they may be connected close to a middle voltage line terminal $M_1$. The tapped windings 15*a* and 15*b* are connected through the load tap changers 16*a* and 16*b* to the neutral point $M_o$, respectively.

It is assumed in this wiring arrangement that the potential difference $e_1$ corresponding to the voltage between taps is caused by untimely operation of the two change-over switches 17*a* and 17*b* of the load tap changers 16*a* and 16*b*. Then, the circulating current $I_c$ is flowed in the closed circuit constituted by the middle voltage windings 13*a* and 13*b*, middle voltage partial windings 23*a* and 23*b*, and tap changers 16*a* and 16*b* including the tapped windings 15*a* and 15*b*, respectively. The total inductance, $L_{2315}$ of the middle voltage partial windings 23*a* and 23*b* and the tapped windings 15*a* and 15*b* can be expressed by $$L_{2315}=L_{2315a}+L_{2315b}+2M_{2315ab} \quad (11)$$

$$L_{2315a}=\mu S(N_{2315a})^2/l \quad (12)$$

$$L_{2315b}=\mu S(N_{2315b})^2/l \quad (13)$$

$$M_{2315ab}=K\sqrt{L_{2315a}\cdot L_{2315b}} \quad (14)$$

where the $N_{2315a}$, $N_{2315b}$ is the sum of the numbers of turns of the middle voltage partial winding 23*a*, 23*b* and the tapped winding 15*a*, 15*b*, respectively.

Figure 6:
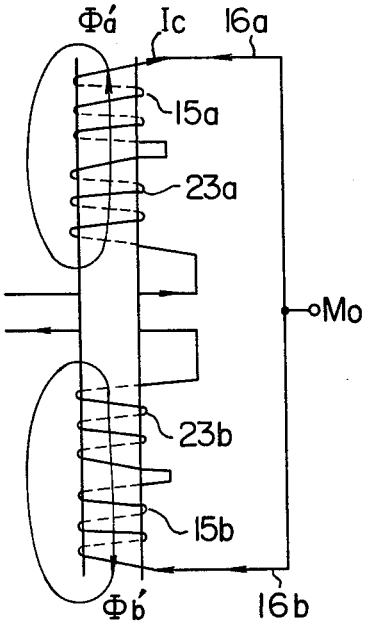
FIG. 6 is an explanatory diagram useful for explaining the relation between the circulating current and magnetic flux in the middle voltage partial windings and tapped windings of the three winding transformer shown in FIG. 5.

By the way, as shown in FIG. 6, the magnetic flux $\Phi'_a$ induced by the circulating current $I_c$ flowing in the middle voltage partial winding 23*a* and the tapped winding 15*a* is opposed in direction to the magnetic flux $\Phi'_b$ induced by the current $I_c$ flowing in the middle voltage partial winding 23*b* and the tapped winding 15*b* because the windings 23*a*, 15*a*, 23*b* and 15*b* are wound in selected directions for the opposite flux. Therefore, the magnetic coupling between the middle voltage partial windings 23*a* and 23*b* and between the tapped windings 15*a* and 15*b* is decreased to an extent that the coupling coefficient K in eq. (14) is approximately zero. Consequently, the inductance $L_{2315}$ exists as a leakage inductance. This inductance $L_{2315}$ can be designed to be about several hundred ohms by properly selecting the numbers of turns $N_{23a}$ and $N_{23b}$ of the middle voltage partial windings 23*a* and 23*b*. In a transformer of $$\frac{800}{3} / \frac{500}{\sqrt{3}} / (220 \pm 33) / \sqrt{3} / 132 \text{ KV}$$

closs type, the inductance $L_{2315}$ is about 100 Ω with the $N_{23a}$ and $N_{23b}$ selected approximately 30% of the middle voltage winding.

Therefore, even though the potential difference between taps of each tapped winding 15*a*, 15*b* is several thousand volts, the circulating current $I_c$ due to the inductance $L_{2315}$ can be reduced to several tens of amperes. Thus, the current capacity at the contacts of the change-over switches in the load tap changer is not exceeded irrespective of whether or not the change-over switches 17*a* and 17*b* operate simultaneously upon change-over of taps, and hence the tap changers can be prevented from being incapable of switching. This does not need the provision of a load tap changer of a large capacity permitting a large amount of circulating current, from the first.

In the embodiment of FIG. 6, since the middle voltage partial windings 23*a* and 23*b* are connected close to the neutral point of the middle voltage windings 13*a* and 13*b*, respectively, lead wires having a relatively low insulation resistance can be used for the middle voltage partial windings 23*a* and 23*b* and the tapped windings 15*a* and 15*b*.

Although two parallel-connected middle voltage windings are used in the embodiment of FIG. 5, a single middle voltage winding may be used to be connected to the two parallel-connected middle voltage partial windings 23*a* and 23*b* and tapped windings 15*a* and 15*b* without any trouble in the enforcement of the invention.

Figure 7:
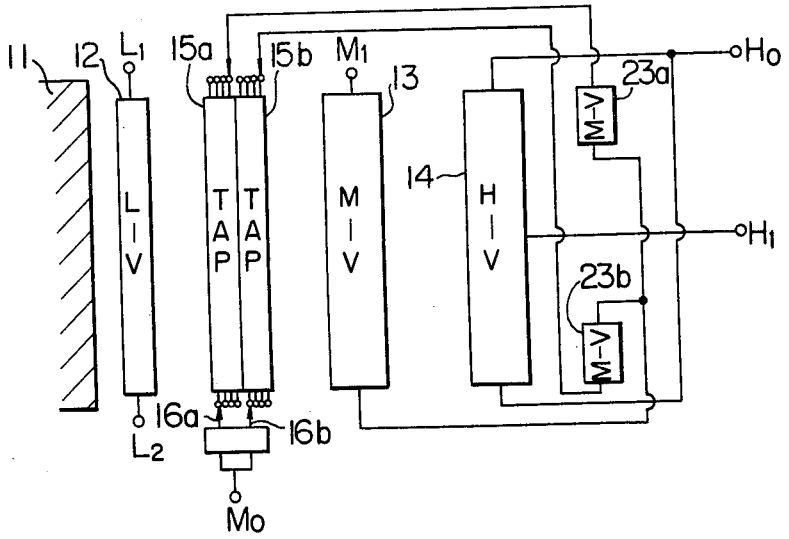
FIG. 7 shows a winding arrangement of another embodiment of the three winding transformer according to the invention in which the tapped windings are provided between the low voltage winding and the middle voltage winding.

FIG. 7 shows another embodiment of the present invention. On the magnetic core 11 are wound the low voltage winding 12, the two parallel-connected tapped windings 15*a* and 15*b* both coaxially disposed, the middle voltage winding 13, and the high voltage winding 14 in order. In addition, on the high voltage winding 14 is coaxially wound the two parallel-connected middle voltage partial windings 23*a* and 23*b* at areas separated by a necessary distance for insulation therebetween. Although in this embodiment the two parallel-connected middle voltage partial windings 23*a* and 23*b* are connected in series with the middle voltage winding 13 at a position close to the neutral point thereof, the middle voltage partial windings 23*a* and 23*b* may be connected at a position close to the middle voltage line terminal $M_1$ of the middle voltage winding 13. The middle voltage partial windings 23*a* and 23*b* are connected in series with the tapped windings 15*a* and 15*b*, respectively.

Figure 8:
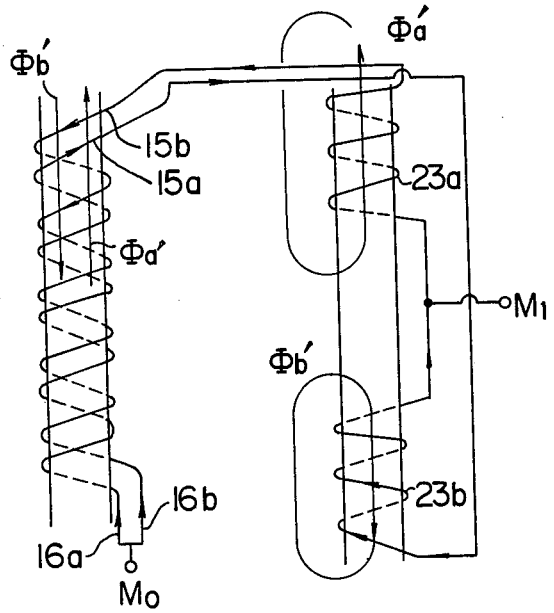
FIG. 8 is an explanatory diagram useful for explaining the relation between the circulating current and magnetic flux in the middle voltage partial windings and tapped windings of the three winding transformer shown in FIG. 7.

In the embodiment of FIG. 7, the windings 23*a* and 23*b* are so wound that, as shown in FIG. 8, the magnetic fluxes $\Phi'_a$, $\Phi'_b$ induced when the circulating current $I_c$ flows in the middle voltage partial winding 23*a*, 23*b* are opposite in direction to each other. In addition, the magnetic fluxes $\Phi'_a$, $\Phi'_b$ induced when the circulating current $I_c$ flows in the tapped winding 15*a*, 15*b* are opposite in direction to each other. Thus, the magnetic coupling between the middle voltage partial windings 23*a* and 23*b* and between the tapped windings 15*a* and 15*b* is reduced to an extent that the coupling coefficient K therebetween is approximately zero as in the embodiment of FIG. 5. Thus, the wiring arrangement of FIG. 7 is able to reduce the circulating current based on the flux linkage difference between the tapped windings 15*a* and 15*b* and also the circulating current due to the untimely operation of the change-over switches 17*a* and 17*b* upon change of tap. In addition, this circulating current can be restricted not to exceed the allowable current capacity of the contacts of the change-over switches 17*a* and 17*b* in the load tap changers 16*a* and 16*b*. Furthermore, the tapped windings 15*a* and 15*b* are coaxially disposed between the low voltage winding 12 and the middle voltage winding 13 and the middle voltage partial windings 23*a* and 23*b* are wound on the high voltage winding 14, so that the impedance between the low voltage winding and middle voltage winding can be much increased thereby permitting decrease of the cutoff current capacity of the circuit breaker to be connected to the low voltage winding.

It will be apparent that many modifications and variations may be effected without departing from the scope of the novel concepts of this invention.

We claim:

1. A three winding transformer comprising:

(a) a magnetic core;

(b) low, middle and high voltage windings each inductively coupled to said magnetic core and which are coaxially wound on said magnetic core in that order; and (c) two tap changers constituting a parallel circuit each including a tapped winding for tap change-over upon loading and which each have one end connected to said middle voltage winding and the other ends connected together;

wherein further comprising middle voltage partial windings which are each connected in series between said middle voltage winding and said tap winding, and which are wound separately on the outside of said high voltage winding so that a circulating current in said parallel circuit will induce magnetic flux of opposite direction through each of the middle voltage partial windings of which one ends are connected to said middle voltage winding and of which the other ends are connected to said tap windings in said two tap changers.

2. A three winding transformer according to claim 1 wherein said middle voltage partial windings are each connected at a point close to the neutral point of the middle voltage winding.

3. A three winding transformer according to claim 1 wherein said middle voltage winding is formed of two parallel-connected windings which are each connected in series with the respective middle voltage partial winding.

4. A three winding transformer according to claim 1, 2 or 3 wherein each of said tap windings is wound coaxial with each of said middle voltage partial windings and on the corresponding side to the line terminal of the high voltage winding and the winding direction of each of said tap windings coincides with that of each of said middle voltage partial windings.

5. A three winding transformer according to claim 1, 2 or 3 wherein said tap windings are formed of two parallel-connected windings and coaxially wound between said low voltage winding and said middle voltage winding.

* * * * *